US007214205B2

(12) United States Patent
Sils

(10) Patent No.: US 7,214,205 B2
(45) Date of Patent: May 8, 2007

(54) EXERCISE GEL BALL AND METHOD OF USE

(76) Inventor: Peter Sils, 108 W. Preston St., Lexington, VA (US) 24450

( * ) Notice: Subject to any disclaimer, the term of this patent is extended or adjusted under 35 U.S.C. 154(b) by 341 days.

(21) Appl. No.: 10/781,807

(22) Filed: Feb. 20, 2004

(65) Prior Publication Data

US 2004/0193081 A1 Sep. 30, 2004

Related U.S. Application Data

(60) Provisional application No. 60/458,041, filed on Mar. 28, 2003.

(51) Int. Cl.
*A61H 15/00* (2006.01)

(52) U.S. Cl. ..... 601/131; 601/134

(58) Field of Classification Search ..... 601/131, 601/134, 135; 482/148
See application file for complete search history.

(56) References Cited

U.S. PATENT DOCUMENTS

| | | | | |
|---|---|---|---|---|
| 754,925 | A * | 3/1904 | Adusht-Hanish | 601/131 |
| 2,466,470 | A * | 4/1949 | Norris | 601/131 |
| 6,093,159 | A | 7/2000 | Racoosin | |
| 6,217,504 | B1 | 4/2001 | Phillips | |
| 6,241,696 | B1 | 6/2001 | York | |
| 2005/0015025 | A1 * | 1/2005 | Stein | 601/15 |
| 2005/0015032 | A1 * | 1/2005 | Stein | 601/131 |
| 2005/0283100 | A1 * | 12/2005 | Whittier | 601/131 |

* cited by examiner

*Primary Examiner*—Danton DeMille
(74) *Attorney, Agent, or Firm*—Clark & Brody

(57) ABSTRACT

A method of pressing on pressure points and/or muscles in a back or other part of a user using a round ball is improved by pressing on the pressure points and/or muscles using a gel ball having a diameter of between about 45 and 70 millimeters. The density of the gel ball ranges between about 0.75 and 1.2 gm/cm$^3$, and the ball being made of a polyether polyol gel material.

15 Claims, 1 Drawing Sheet

EXERCISE GEL BALL AND METHOD OF USE

This application claims priority under 35 USC 119(e) based on provisional patent application No. 60/458,041 filed on Mar. 28, 2003.

FIELD OF THE INVENTION

The present invention is directed to a specially sized and formulated massage/exercise ball and its method of use.

BACKGROUND ART

In the prior art, the use of various types of massage/exercise balls is well known in the art. However, many balls are either the wrong size or wrong material to use in exercise or massage techniques, especially massages or exercises involving the muscles and pressure points found on a person's back or other parts of the person's body.

Accordingly, a need has developed to provide an improved massage/exercise ball and method of use, and one that is particularly suited for use in conjunction with a person's back, and where the ball rests on a hard surface, and a user's back contacts the ball while on this hard surface.

SUMMARY OF THE INVENTION

It is a first object of the invention to provide an improved exercise/massage ball, particularly for use on hard surface and in contact with a user's back.

Another object of the invention is a method of exercising or massaging wherein the inventive ball is placed on a hard surface or held by a person or inanimate object, and a user presses on the ball with a part of the user's body. The ball can remain stationary, or the ball and/or person can move so that the ball can contact other areas of the person's body during the pressing step.

Other objects and advantages will become apparent as a description thereof proceeds.

In satisfaction of the foregoing objects and advantages, the present invention is an improvement in exercise techniques that use a round ball to apply pressure to pressure points and/or muscles on a person's back or other parts of the body. The inventive method uses a round gel ball having a diameter of between about 45 and 70 millimeters, and a density ranging between about 0.75 and 1.2 gm/cm$^3$. The ball is made of a polyether polyol gel material. More preferably, the diameter ranges between 50–60 millimeters and even more preferable 50–57 millimeters with an optimum diameter of around 54–55 millimeters. A preferred range for the density is 0.90 and 1.1 gm/cm$^3$, with a target of that approximating water or 1.0 gm/cm$^3$.

When using the ball for massage, exercise or some other therapy routine, the ball may be placed on a hard generally horizontal surface, with the user pressing the user's back or other part against the ball while keeping the ball stationary. In another mode, the ball can be placed on a hard generally horizontal surface, and the user can press the back of other part of the user against the ball and at the same time, the user moves the back or other part so that the ball contacts other areas of the back or body during the pressing step. In yet another mode, the ball can be held by a person or other inanimate holder, and the user presses the back or other body part against the ball while the ball is held stationary. One other mode involves the ball being held by a person or other holder. The user then presses the back or another body part of the user against the ball and at the same time, moves the back of other body part so that the ball contacts other areas of the back or body during the pressing step.

The invention not only entails use of the exercise ball but the actual ball itself, including the broad and preferred embodiments outlined in conjunction with the inventive method.

DESCRIPTION OF THE PREFERRED EMBODIMENTS

The present invention offers a superior way to relieve muscle pain, particularly back pain via the use of the pressure points found in one's back. More particularly, a gel ball is provided having just the right size, material, and density to be used in exercises/massage to relieve muscle aches and pain, particularly back pain.

The ball has a preferred diameter range between 50 and 57 millimeters, with a target diameter being about 54–55 millimeters. However, it is believe that ball diameters between about 45 to 60 or up to 70 millimeters are also adaptable for use within the scope of the invention. The size of the ball is important in that if the size is too large or too small, the exercises involving the back or other parts of the body become less effective.

The density of the ball is also important. If the ball is too soft, the desired effect on a user's back is lost. If the ball is too hard, the exercise routine becomes uncomfortable, and the relief from pain and aches is not achieved. A density range for the ball is between about 0.75 to 1.2 gm/cm$^3$, with a preferred range being, 0.9 to 1.1, and a target being around 1.0 gm/cm$^3$.

The ball is made of a gel material, a polyether polyol type material that is similar to a polyurethane. The actual ball is manufactured by Huizhgu Hui Lon Plastic Pty., adidas-Salomon Taichung Office, of Hong Kong, China, and the manufacturer's name and code for the material is XFP-1013. The balls can be obtained from the manufacturer or its distributor Flow Tack Co., Ltd, 9F-2, No. 68, Road 1st, Taichung Industrial Park, Taichung 407, Taiwan, R.O.C. The actual ball is made by molding and a mold seam is present around the ball circumference if this process is used. Of course, the ball could be made in any known way.

Figure 1:
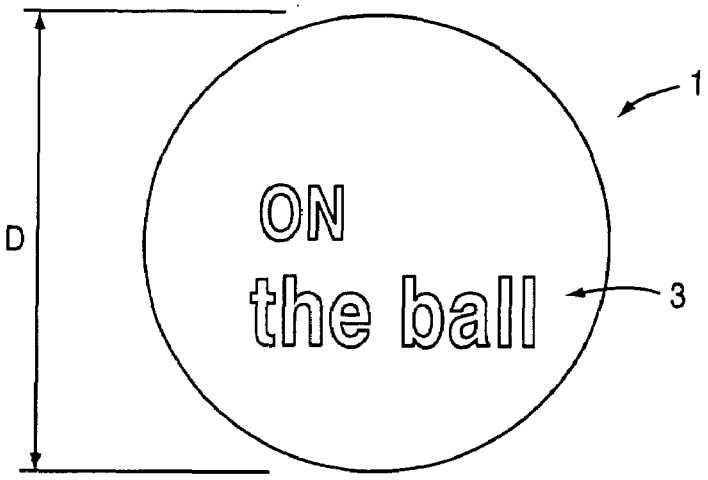
FIG. 1 shows an exemplary ball.

An exemplary ball is shown in FIG. 1 as reference numeral 1. The ball 1 is shown with a logo 3 on the surface of the ball. The logo is optional, but is preferred for advertising purposes. The ball can be made in any color or even be made clear, but a blue color is preferred since this color connotes a more peaceful meaning, which is conducive to the intended benefits of the ball when used. FIG. 1 also illustrates the diameter of the ball as "D."

Figure 2:
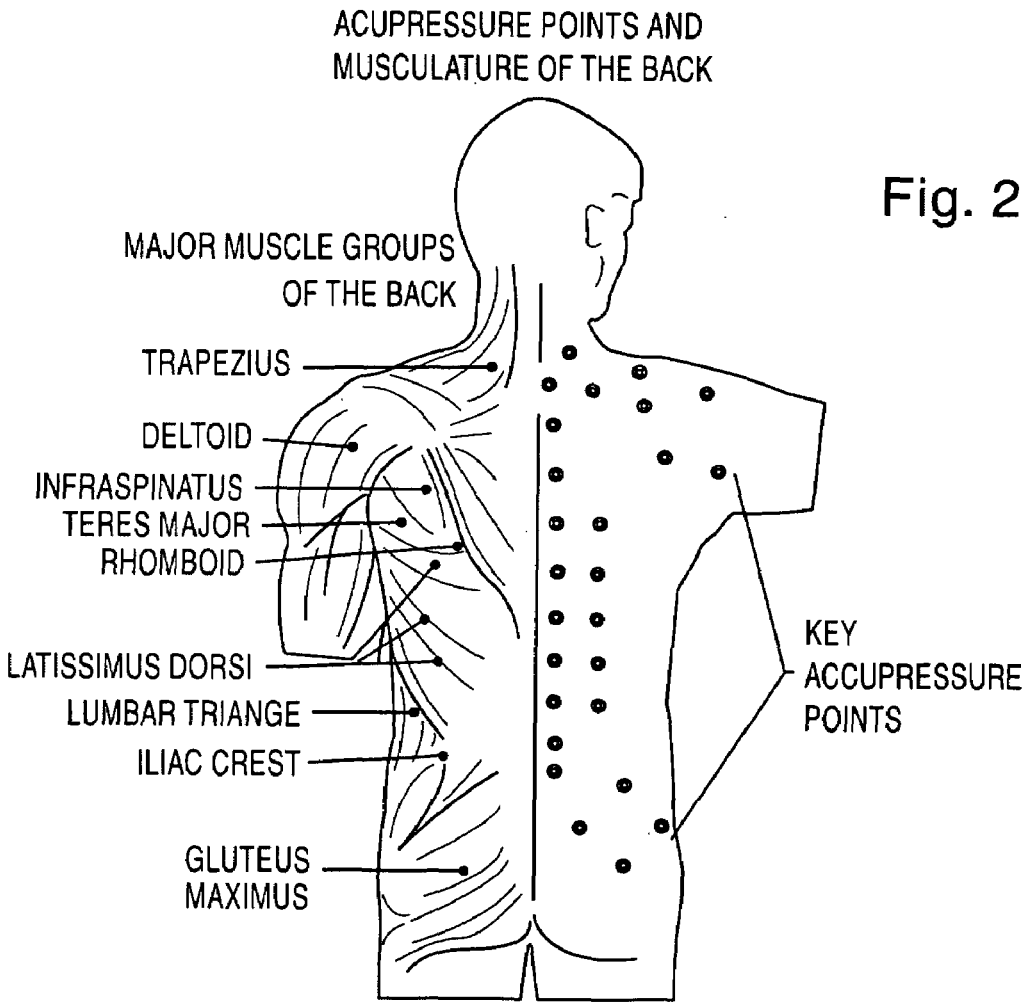
FIG. 2 shows a rear view of a user's back with muscles and pressure points.

FIG. 2 shows the musculature and acupressure points of a human being's back. It is these muscle groups and pressure points that are intended, in one mode of the inventive method, to be contacted by the ball during use. In a preferred use for this mode, a user lays the ball on a hard surface such as a tile, wooden or linoleum floor. The user then positions the user's body on the floor such that the back can come in contact with the ball. A user can then press the back against the ball, and particularly, try to center the ball on one of the acupressure points. The user can remain stationary during this pressing operation, and then position the back such that the ball contacts another area of the back for another period of time.

In another mode, the user can move the back while pressing against the ball so that other areas of the back are contacted during the pressing step and while the back and/or ball is moving. When moving the back, the ball will likely also move along the floor surface. This a dynamic type of exercise as compared to the static exercise where just one area of the back is urged against the ball for a set period of time.

In yet another mode, instead of the floor, the ball could be held against the back or other part of a user by another person (the holder). The pressing steps or pressing and moving steps can be accomplished by the holder, the user, or a combination of both.

One other mode may have the ball held in a stationary position by an inanimate holder, and the user would then either press against the ball when held in place, or press and move during the pressing step.

While the primary use of the ball is for the back and a hard horizontal surface such as a floor, other parts of a person's body could also contact the ball, and the ball may be located in other places than on a horizontal surface, e.g., a vertical surface. The ball can also contact legs, arms, the neck, or any other part of the body that may need massage or exercise relief.

Another use associated with the inventive ball is while driving or riding in a vehicle, such as a car, truck, bus or the like. More specifically, a person can position the ball between the person's back and a seat or other surface in the vehicle and use the ball in the same manner as described above, i.e., move a body part with respect to the ball, or merely press against the ball when it is stationary. This form of relief can be quite advantageous since a person can obtain back pain relief while driving or as a passenger in a moving vehicle.

As such, an invention has been disclosed in terms of preferred embodiments thereof which fulfills each and every one of the objects of the present invention as set forth above and provides a new and improved exercise and massage ball as well as methods of use.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. In a method of pressing on pressure points and/or muscles in a back or other part of a user using a round ball, the improvement comprising pressing on the pressure points and/or muscles using a gel ball having a diameter of between about 45 and 70 millimeters, and density ranging between about 0.75 and 1.2 gm/cm$^3$, the ball being made of a polyether polyol gel material.

2. The method of claim 1, wherein the ball diameter is between 50 and 60 millimeters.

3. The method of claim 2, wherein the ball diameter is around 54–55 millimeters.

4. The method of claim 1, wherein the density ranges between 0.90 and 1.1 gm/cm$^3$.

5. The method of claim 3, wherein the density is around 1.0 gm/cm$^3$.

6. The method of claim 1, wherein the ball is placed on a hard generally horizontal surface, and the user presses the back or other part against the ball while keeping the ball stationary.

7. The method of claim 1, wherein the ball is placed on a hard generally horizontal surface, and the user presses the back of other part of the user against the ball and at the same time, moves the back or other part so that the ball contacts other areas of the back or other part during the pressing step.

8. The method of claim 1, wherein the ball is held by a person or other inanimate holder, and the user presses the back or other part against the ball while the ball is held stationary.

9. The method of claim 1, wherein the ball is held by a person or other holder, and the user presses the back or other part of the user against the ball and at the same time, moves the back of other part so that the ball contacts other areas of the back or other part during the pressing step.

10. The method of claim 1, wherein the ball is placed between a surface located in a vehicle and a part of the user's body as part of said pressing step.

11. An exercise gel ball being made of a polyether polyol gel material, having a diameter of between about 45 and 70 millimeter, and having a density ranging between about 0.75 and 1.2 gm/cm$^3$.

12. The exercise ball of claim 11, wherein the ball diameter is between 50 and 60 millimeters.

13. The exercise ball of claim 12, wherein the ball diameter is around 54–55 millimeters.

14. The exercise ball of claim 11, wherein the density ranges between 0.90 and 1.1 gm/cm$^3$.

15. The exercise ball of claim 14, wherein the ball density is around 1.0 gm/cm$^3$.

* * * * *